US008381511B2

(12) United States Patent
Suzuki

(10) Patent No.: US 8,381,511 B2
(45) Date of Patent: Feb. 26, 2013

(54) INTERNAL COMBUSTION ENGINE CONTROL APPARATUS AND METHOD

(75) Inventor: Yusuke Suzuki, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 614 days.

(21) Appl. No.: 12/594,949

(22) PCT Filed: May 23, 2008

(86) PCT No.: PCT/IB2008/001307

§ 371 (c)(1),
(2), (4) Date: Oct. 7, 2009

(87) PCT Pub. No.: WO2008/146127

PCT Pub. Date: Dec. 4, 2008

(65) Prior Publication Data

US 2010/0050600 A1 Mar. 4, 2010

(30) Foreign Application Priority Data

May 25, 2007 (JP) ..... 2007-138696

(51) Int. Cl.
*F01N 3/00* (2006.01)
*F01N 3/10* (2006.01)

(52) U.S. Cl. ..... 60/276; 60/286; 60/303

(58) Field of Classification Search ..... 60/276, 60/286, 295, 301, 303; 123/325, 332, 198 DB
See application file for complete search history.

(56) References Cited

U.S. PATENT DOCUMENTS

| | | | | |
|---|---|---|---|---|
| 6,227,033 | B1 | 5/2001 | Kainz | |
| 6,374,818 | B2 * | 4/2002 | Shinjyo et al. | 123/688 |
| 2007/0023020 | A1 | 2/2007 | Yoshidome | |

FOREIGN PATENT DOCUMENTS

| | | |
|---|---|---|
| DE | 102 27 177 | 1/2003 |
| DE | 603 00 545 T2 | 2/2006 |
| EP | 1 333 171 | 8/2003 |
| EP | 1 748 173 | 1/2007 |
| JP | 2003 214245 | 7/2003 |
| WO | 2007 026229 | 3/2007 |

OTHER PUBLICATIONS

German Office Action issued Apr. 4, 2012 in patent application No. 11 2008 000 754.3 with English translation.

* cited by examiner

*Primary Examiner* — Kenneth Bomberg
*Assistant Examiner* — Audrey K Bradley
(74) *Attorney, Agent, or Firm* — Oblon, Spivak, McClelland, Maier & Neustadt, L.L.P.

(57) ABSTRACT

An ECU performs atmospheric learning to correct an individual difference in an A/F sensor. In this case, when reducing fuel has been added before a fuel cut, the ECU calculates, at fixed intervals, the total amount of reducing fuel added and the total amount of oxygen flowing through an exhaust passage. The ECU then estimates the remaining amount of reducing fuel remaining in the exhaust passage using these total amounts, and performs atmospheric learning when the remaining amount is equal to or less than an allowable value. As a result, atmospheric learning can be accurately performed at the earliest possible timing even if the timing at which the reducing fuel is added or the operating state of an internal combustion engine or the like changes.

16 Claims, 9 Drawing Sheets

INTERNAL COMBUSTION ENGINE CONTROL APPARATUS AND METHOD

BACKGROUND OF THE INVENTION

1. Field of the Invention

The invention relates to a control apparatus and method that controls the operating state of an internal combustion engine. More particularly, the invention relates to an internal combustion engine control apparatus and method that controls the air-fuel ratio according to the oxygen concentration in the exhaust gas.

2. Description of the Related Art

Japanese Patent Application Publication No. 2003-214245 (JP-A-2003-214245), for example, describes a control apparatus that performs air-fuel ratio control using an oxygen concentration sensor provided in an exhaust passage. This control apparatus performs learning control, referred to as atmospheric learning, for learning error in the oxygen concentration sensor that is due to manufacturing variation and deterioration over time and the like.

In this atmospheric learning, when the atmosphere in the exhaust passage becomes an air atmosphere because a fuel cut is performed in the engine, a detection signal output from the oxygen concentration sensor is compared with a reference signal value stored in advance in the control apparatus. This reference signal value corresponds to the oxygen concentration in the atmosphere which is known. The amount that the actual detection value is off from the reference signal value is a value that corresponds to the error inherent in each sensor so it is stored in the control apparatus as a learned value for correcting the error inherent in the sensor.

Also, the control apparatus performs a reduction process of a catalyst by adding fuel into the exhaust gas (hereinafter this fuel will be referred to as "reducing fuel" to avoid confusion with fuel that is normally injected during normal fuel injection). When there is a fuel cut immediately after the reducing fuel has been added, the rate of increase in the oxygen concentration slows from the effect of the reducing fuel remaining in the exhaust gas, resulting in a time lag until the oxygen concentration reaches the concentration level in the atmosphere. Therefore, when a fuel cut starts, the control apparatus determines whether there is a history of reducing fuel having been added within a predetermined period of time immediately before the start of the fuel cut. If there is a history, the control apparatus prohibits atmospheric learning.

In this way, if reducing fuel has been added within a predetermined period of time before the start of a fuel cut, the control apparatus prohibits atmospheric learning. However, the period of time after the reducing fuel has been added until atmospheric learning is possible varies depending on the timing at which the reducing fuel is added and the operating state and the engine and the like. Therefore, simply prohibiting the atmospheric learning, as is done with the control apparatus described above, may result in missed learning opportunities, which reduces learning efficiency.

Also, if the specific value of the predetermined period of time is set low in order to increase the learning efficiency, learning may end up being performed while the effects of the reducing fuel that has been added still remain, and as a result, the learning may be erroneous. In this way, with the control apparatus described above, it is difficult to appropriately set the timing of the atmospheric learning when reducing fuel is added.

SUMMARY OF THE INVENTION

This invention provides an internal combustion engine control apparatus and method capable of improving learning accuracy and efficiency by performing atmospheric learning at an appropriate timing according to the timing at which reducing fuel is added and the operating state of the internal combustion engine and the like.

A first aspect of the invention relates to an internal combustion engine control apparatus which includes reducing fuel adding means for adding reducing fuel into exhaust gas of the internal combustion engine; oxygen, concentration detecting means for detecting an oxygen concentration in the exhaust gas and outputting a detection signal indicative of the detected oxygen concentration; and a controller that controls an operating state of the internal combustion engine. The controller includes fuel cutting means for, when a fuel injection is performed into intake air of the internal combustion engine, halting the fuel injection according to the operating state of the internal combustion engine; total reducing fuel amount calculating means for calculating the total amount of reducing fuel added into the exhaust gas between the time that the reducing fuel adding means starts to add the reducing fuel and the time that the reducing fuel adding means stop adding the reducing fuel; total oxygen amount calculating means for calculating, using the detection result from the oxygen concentration detecting means, the total amount of oxygen in the total amount of exhaust gas discharged from the internal combustion engine after the reducing fuel adding means has stopped adding the reducing fuel; remaining amount determining means for determining whether the reducing fuel in the exhaust gas has decreased to an allowable value based on the total amount of reducing fuel calculated by the total reducing fuel amount calculating means and the total amount of oxygen calculated by the total oxygen amount calculating means; and learning means for performing atmospheric learning using the detection result from the oxygen concentration detecting means when the fuel cutting means is halting the fuel injection and it has been determined by the remaining amount determining means that the reducing fuel in the exhaust gas has decreased to the allowable value.

Also, the total reducing fuel amount calculating means may calculate the total amount of the reducing fuel by calculating an added amount of the reducing fuel per unit time according to the amount of reducing fuel added into the exhaust gas by the reducing fuel adding means, and integrating the calculated value of the added amount each time the unit time passes.

The control apparatus may also include intake air amount detecting means for detecting a flowrate of air drawn into the internal combustion engine as an intake air amount. Also, the total oxygen amount detecting means may calculate the total amount of the oxygen by calculating the flowrate of oxygen per unit time using the intake air amount detected by the intake air amount detecting means and the oxygen concentration detected by the oxygen concentration detecting means, and integrating the calculated value of the flowrate each time the unit time passes.

Moreover, the control apparatus may also include exhaust gas recirculating means for recirculating some of the exhaust gas into an intake system of the internal combustion engine. Also, the total oxygen amount calculating means may calculate the flowrate of the oxygen using the flowrate of the exhaust gas recirculated into the intake system by the exhaust gas recirculating means, the intake air amount, and the oxygen concentration.

On the other hand, a second aspect of the invention relates to an internal combustion engine control apparatus that includes reducing fuel adding means for adding reducing fuel into exhaust gas of the internal combustion engine; oxygen concentration detecting means for detecting an oxygen concentration in the exhaust gas and outputting a detection signal indicative of the detected oxygen concentration; and a controller that controls an operating state of the internal combustion engine. The controller includes fuel cutting means for, when a fuel injection is performed into intake air of the internal combustion engine, halting the fuel injection according to the operating state of the internal combustion engine; time measuring means for measuring the time that has passed after the reducing fuel adding means adds the reducing fuel until the fuel cutting means halts the fuel injection, as a post-addition time; standby time setting means for variably setting a learning standby time according to the post-addition time measured by the time measuring means; and learning means for performing atmospheric learning using the detection result from the oxygen concentration detecting means when the learning standby time has passed after the fuel cutting means halted the fuel section.

Also, the controller may include i) reference time setting means for setting, as a reference time, the time that it takes for the learning means to be able to perform atmospheric learning normally after the fuel cutting means halts the fuel injection, even if there is no effect from the reducing fuel added by the reducing fuel adding means; and ii) determined time calculating means for calculating, as a determined time, the shortest post-addition time with which the learning standby time can still be set equal to the reference time even if the reducing fuel adding means adds reducing fuel before the fuel cutting means halts the fuel injection. Also, the standby time setting means may correct the learning standby time according to a time difference between the actual post-addition time measured by the time measuring means and the determined time when the actual post-addition time measured by the time measuring means is shorter than the determined time, and set the learning standby time equal to the reference time when the actual post-addition time is equal to or longer than the determined time.

A third aspect of the invention relates to an internal combustion engine control method that includes the steps of executing fuel cut control; calculating the total amount of reducing fuel added into exhaust gas between the time the reducing fuel starts to be added and the time the reducing fuel stops being added; calculating the total amount of oxygen in the exhaust gas flowing through an exhaust passage after the reducing fuel stops being added; calculating the remaining amount of reducing fuel in the exhaust gas based on the calculated total amount of reducing fuel and the calculated total amount of oxygen; comparing the calculated remaining amount of reducing fuel with an allowable value; and performing atmospheric learning when the remaining amount of reducing fuel is less than the allowable value.

According to the first aspect of the invention, the total amount of reducing fuel added to the exhaust gas can be calculated by the total reducing fuel amount calculating means after the reducing fuel has been added. Also, the total oxygen amount calculating means can calculate the total amount of oxygen in the exhaust gas discharged from the internal combustion engine during the period when reducing fuel is not being added. Here, when reducing fuel is added into the exhaust gas, it is consumed by being burned in the exhaust passage which is at a high temperature. The combustion reaction at this time progresses according to the amount of oxygen present in the exhaust gas (i.e., in the air if a fuel cut is being performed). Therefore, the amount of reducing fuel may be presumed to decrease according to the total amount of oxygen in the exhaust gas.

Accordingly, the remaining amount determining means can estimate the remaining amount of reducing fuel in the exhaust gas by comparing the total amount of reducing fuel with the total amount of oxygen, for example, and determine whether this remaining amount has decreased to an allowable value. Therefore, even if the operating state of the internal combustion engine or the timing at which reducing fuel is added or the like changes, the learning means only needs to wait for the period of time during which the remaining amount of reducing fuel estimated according to these conditions exceeds the allowable value. Once the remaining amount of reducing fuel has decreased to the allowable value, normal learning can quickly be started. As a result, the waiting time (i.e., standby time) of the learning means can be kept to the very minimum. Thus, the opportunities for learning can be increased, in turn increasing the efficiency, while high learning accuracy can be maintained.

The total reducing fuel amount calculating means can integrate the added amount of reducing fuel per unit time each time the unit time passes. Accordingly, when the reducing fuel is added, the latest total amount of reducing fuel can be accurately obtained each time the total reducing fuel amount calculating means integrates the added amount of reducing fuel.

The flowrate of the exhaust gas is basically equal to the intake air amount. Therefore, the total oxygen amount calculating means can calculate the flowrate of oxygen per unit time by multiplying the intake air amount by the oxygen concentration, for example, and integrate this flowrate each time the unit time passes. Accordingly, even if the intake air amount and the oxygen concentration are constantly changing, the latest total amount of oxygen in the exhaust gas can be accurately obtained each time the total oxygen amount calculating means integrates the flowrate of oxygen.

When some of the exhaust gas is recirculated into the intake system, the effect from this recirculation can be reflected in the calculation result of the total oxygen amount calculating means. Accordingly, even in an internal combustion engine provided with exhaust gas recirculating means, the total amount of oxygen can be accurately calculated by the total oxygen amount calculating means.

According to the second aspect of the invention, the time measuring means can measure the post-addition time which is from the time the reducing fuel adding means adds the reducing fuel until the fuel cutting means halts the fuel injection. Then, the standby time setting means can appropriately set the learning standby time until atmospheric learning can be performed normally by the learning means after the fuel cutting means halted the fuel injection, according to this post-addition time.

That is, if reducing fuel has been added right before a fuel cut, for example, the learning means can be made to wait until the reducing fuel will no longer affect the learning by setting the learning standby time longer. Also, if a sufficient amount of time has passed after reducing fuel has been added, the learning means can quickly perform learning after the fuel cut starts by setting the learning standby time shorter. Therefore, the learning standby time can be kept to the very minimum even if the operating state of the internal combustion engine or the timing at which reducing fuel is added or the like changes. Thus, the opportunities for learning can be increased which improves efficiency, while high learning accuracy can be maintained.

The reference time setting means can set the learning standby time necessary even if the reducing fuel adding means is not adding reducing fuel, as the reference time. Also, the determined time calculating means can calculate the shortest post-addition time without extending the reference time even if reducing fuel is added right before a fuel cut, as the determined time.

As a result, when the actual post-addition time is shorter than the determined time, it can be determined that the reducing fuel in the exhaust gas will affect the learning by the learning means because the time between the reducing fuel addition and the fuel cut is too short. In this case, the determined time calculating means can appropriately extend the learning standby time by correcting it, and thus set the learning, standby time so that it is just long enough according to the timing at which reducing fuel is added and the like.

BRIEF DESCRIPTION OF THE DRAWINGS

The foregoing and further objects, features and advantages of the invention will become apparent from the following description of embodiments with reference to the accompanying drawings, wherein like numerals are used to represent like elements and wherein.

DETAILED DESCRIPTION OF THE EMBODIMENTS

Figure 1:
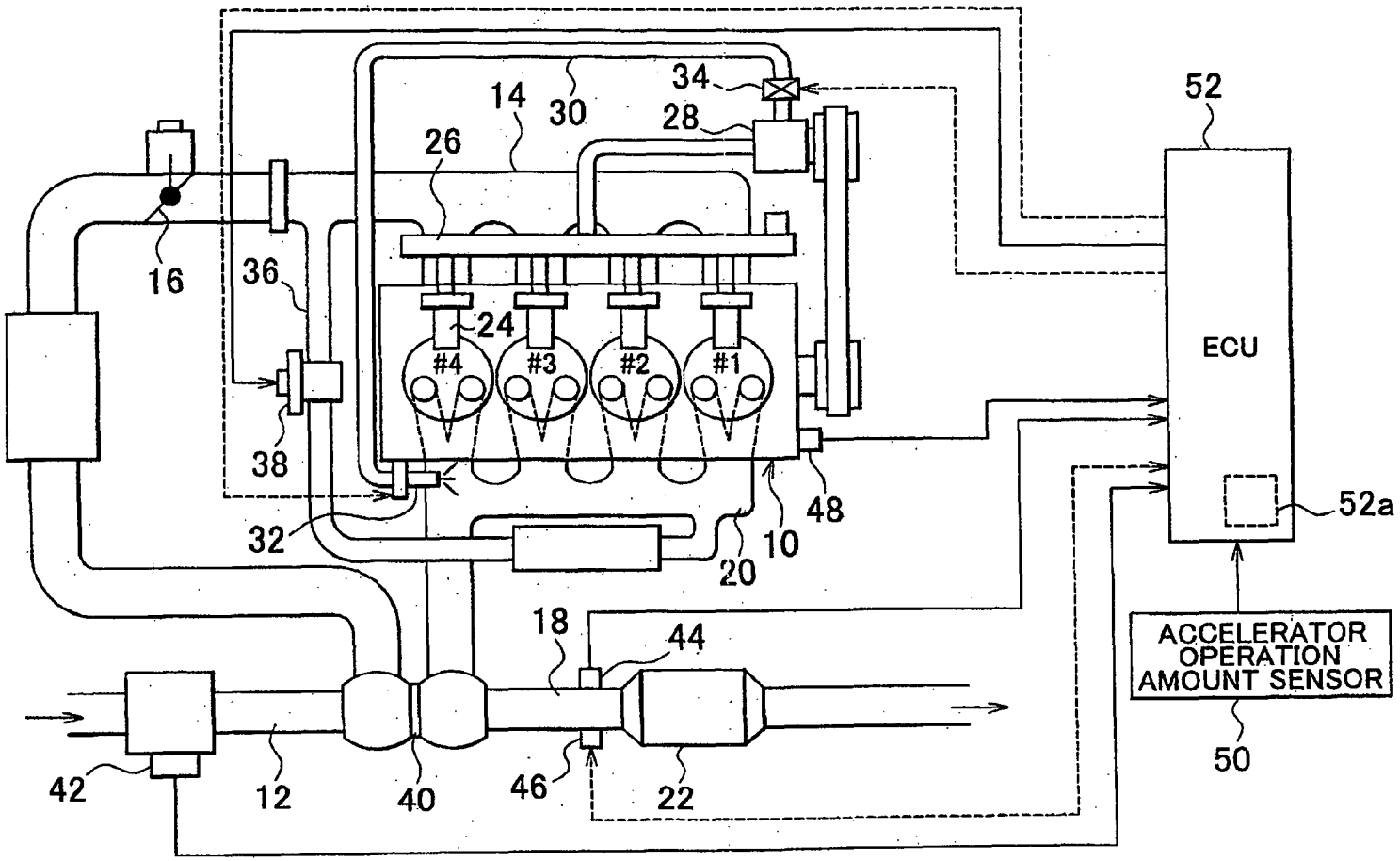
FIG. 1 is a block diagram showing the overall system structure of an internal combustion engine control apparatus according to first and second example embodiments of the invention.

Hereinafter, a first example embodiment of the invention will be described with reference to FIGS. 1 to 4. FIG. 1 is a block diagram showing the system structure according to the example embodiments of the invention. The internal combustion engine 10 shown in FIG. 1 is a four-cylinder diesel engine, for example.

An intake passage 12 that draws air (i.e., intake air) into the cylinders is provided on the intake side of the internal combustion engine 10. This intake passage 12 is connected to an intake port of each cylinder via an intake manifold 14. Also, a throttle valve 16 that adjusts the intake air amount of the internal combustion engine 10 is provided in the intake passage 12.

Meanwhile, an exhaust passage 18 that discharges exhaust gas produced in the cylinders to the outside is provided on the exhaust side of the internal combustion engine 10. This exhaust passage 18 is connected to an exhaust port of each cylinder via an exhaust manifold 20 that constitutes a portion of the exhaust passage 18. Also, an exhaust gas control catalyst 22 which has a $NO_x$ storage-reduction catalyst is provided in the exhaust passage 18. This exhaust gas control catalyst 22 purifies components such as $NO_x$ in the exhaust gas, as well as traps particulate matter (PM) that is in the exhaust gas.

Also, a fuel injection valve 24 that injects fuel into the intake air that is drawn into the cylinders is provided in each cylinder of the internal combustion engine 10. These fuel injection valves 24 are connected to a fuel pump 28 via a common rail 26. The fuel pump 28 is connected to a fuel adding valve 32 via a fuel line 30. This fuel adding valve 32 constitutes reducing fuel adding means and adds fuel (i.e., reducing fuel) into the exhaust gas flowing through the exhaust passage 18. Also, a cut-off valve 34 which opens and closes the fuel line 30 is provided in the fuel line 30.

Furthermore, an EGR (Exhaust Gas Recirculation) passage 36 that serves as exhaust gas recirculating means for recirculating some of the exhaust gas into the intake passage 12 is provided between the intake passage 12 and the exhaust passage 18. An EGR valve 38 that adjusts the flowrate of the exhaust gas that flows through the EGR passage 36 is provided in the EGR passage 36. Also, a turbocharger 40 that supercharges the intake air using the pressure of the exhaust gas is provided between the intake passage 12 and the exhaust passage 18.

Next, the sensor system of the internal combustion engine 10 will be described. The intake passage 12 is provided with an airflow meter 42 that serves as intake air amount detecting means for detecting the flowrate (i.e., the intake air amount) of air drawn into the internal combustion engine 10. The exhaust passage 18 is provided with an exhaust gas temperature sensor 44 that detects the temperature of the exhaust gas, and an A/F sensor 46 which serves as oxygen concentration detecting means for detecting the oxygen concentration in the exhaust gas.

In this case, the A/F sensor 46 is arranged upstream of the exhaust gas control catalyst 22, with respect to the direction in which the exhaust gas flows. Also, the detection signal output from the A/F sensor 46 continually changes according to the oxygen concentration. Furthermore, the internal combustion engine 10 is provided with an engine speed sensor 48 that outputs a signal indicative of the engine speed, and an accelerator operation amount sensor 50 that outputs a signal indicative of the operation amount (depression amount) of an accelerator pedal, not shown.

Also, the system of this example embodiment is provided with an ECU (Electronic Control Unit) 52 that controls the operating state of the internal combustion engine 10. The sensor system, which includes the airflow meter 42 and the various sensors 44, 46, 48, and 50 described above, is connected to the input side of this ECU 52. Various actuators, including the fuel injection valve 24 of each cylinder, the fuel pump 28, the fuel adding valve 32, the cut-off valve 34, and the EGR valve 38 and the like, are connected to the output side of the ECU 52. The ECU 52 controls these actuators while detecting the operating state of the internal combustion engine 10 by the sensor system described above.

Also, the ECU 52 has a timer function for measuring various times, and a memory circuit 52*a* made up of ROM and RAM and the like. Here, the RAM includes nonvolatile, updatable memory elements in which learned values that are updated by atmospheric learning and the like, which will be described later, are stored. Also, programs for executing various control, as well as constants, and the like are stored in advance in the ROM.

The ECU 52 structured in this way executes control routines for normal fuel injection control, air-fuel ratio control, fuel cut control, EGR control, reducing fuel adding control, and atmospheric learning and the like. In this case, in normal fuel injection control, the ECU 52 calculates the appropriate amount of fuel to be injected into the cylinders using the detection results from the sensors 44, 46, 48, and 50, and the like, and injects that fuel into the cylinders from the fuel injection valves 24.

Also, during normal fuel injection control, the oxygen concentration in the exhaust gas is detected by the A/F sensor 46. Then the ECU 52 performs air-fuel ratio control in which it feedback-controls the fuel injection quantity so that the actual air-fuel ratio required according to the detection results of the oxygen concentration come to match a target air-fuel ratio. Also, during fuel cut control, when the internal combustion engine 10 decelerates from high speed or high load operation, for example, the ECU 52 detects that deceleration from the detection signals output by the engine speed sensor 48 and the accelerator operation amount sensor 50 and the like and temporarily halts fuel injection.

Also, during EGR control, the ECU 52 recirculates exhaust gas at an appropriate flowrate back into the intake air by adjusting the opening amount of the EGR valve 38 according to the operating state of the internal combustion engine 10. In this case, the amount of recirculated exhaust gas is set according to a known method based on the speed, load, and intake air amount and the like of the internal combustion engine 10.

Also, the reducing fuel adding control performs a reduction process of the exhaust gas control catalyst 22. This reduction process is executed at the necessary timing. In this reducing fuel adding control, fuel to be used in the reduction process (hereinafter this fuel will be referred to as "reducing fuel") is added into the exhaust gas from the fuel adding valve 32, whereby it reduces components such as $NO_x$ in the exhaust gas, thereby enabling the exhaust gas control catalyst 22 to recover its exhaust gas purifying ability.

Meanwhile, during atmospheric learning, when the atmosphere in the exhaust passage 18 has become an air atmosphere due to a fuel cut being performed, the detection signal output from the A/F sensor 46 is stored as a learned value. A reference signal value for the sensor signal is stored beforehand in the memory circuit 52*a* of the ECU 52. This reference signal value is a detection signal value obtained from detecting the oxygen concentration in the atmosphere using, for example, a A/F sensor that is a standard from which error inherent in the sensor has been eliminated.

Any difference between the detection signal (i.e., the learned value) of the A/F sensor 46 in the air atmosphere and the reference signal value corresponds to error inherent in the sensor. Therefore, when performing air-fuel ratio control, the detection signal from the A/F sensor 46 is corrected using the reference signal value and the learned value stored from atmospheric learning.

Atmospheric learning is performed after a predetermined period of time has passed after a fuel cut has been executed so that the atmosphere within the exhaust passage 18 is a stable air atmosphere when it is performed. However, if reducing fuel has been added right before the fuel cut, it will take longer for that atmosphere to become an air atmosphere due to the affect from the reducing fuel remaining in the exhaust gas.

Figure 5:
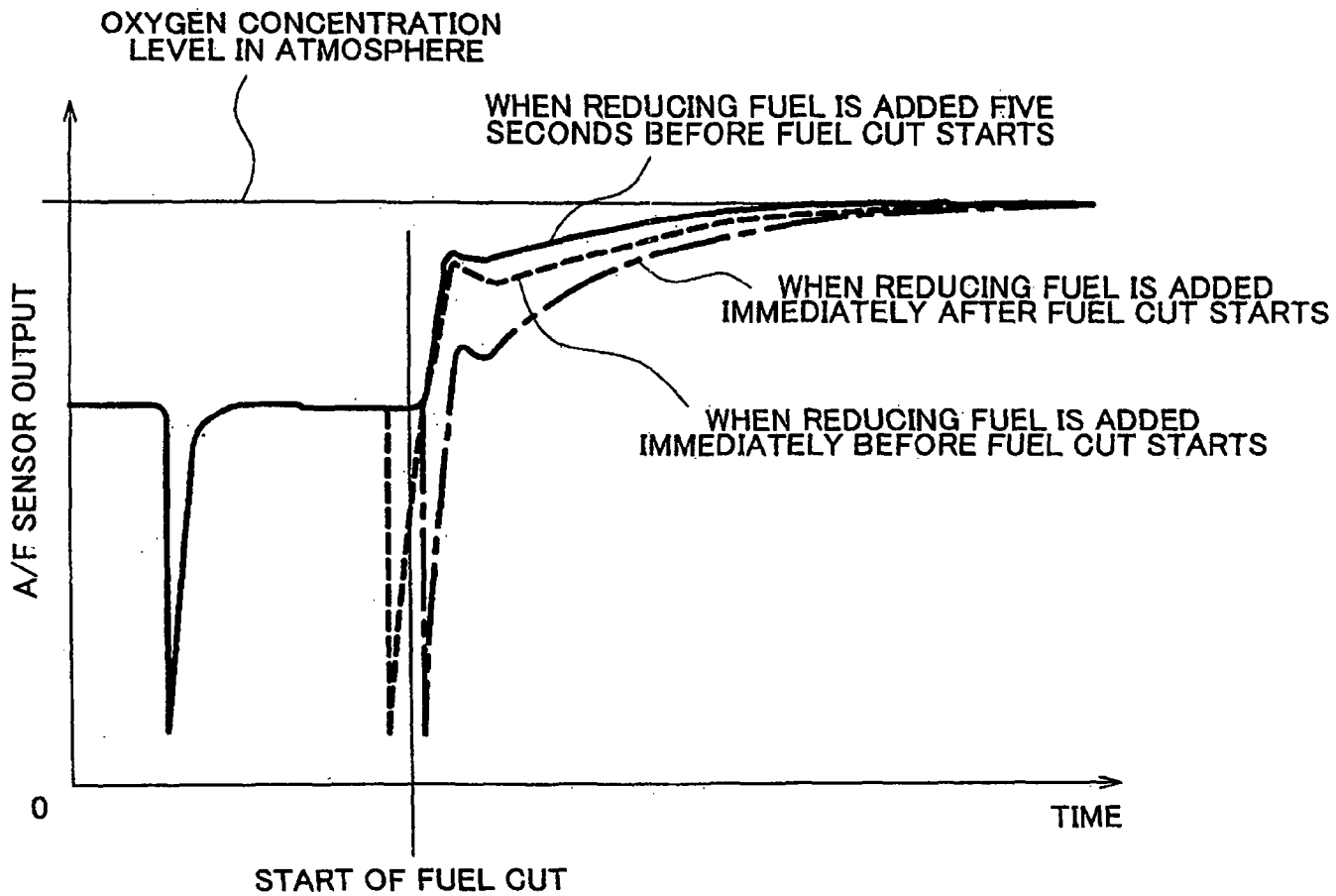
FIG. 5 is a characteristics line graph showing the relationship between the timing at which reducing fuel is added and the oxygen concentration after a fuel cut.

FIG. 5 is a chart showing this phenomenon as empirical data. In the chart, the solid line shows the behavior of the detection signal from the A/F sensor 46 when reducing fuel is added five seconds before a fuel cut starts, the dotted line shows the behavior of the detection signal from the A/F sensor 46 when reducing fuel is added right before the fuel cut starts, and the alternate long and short dash line shows the behavior of the detection signal from the A/F sensor 46 when reducing fuel is added right after the fuel cut starts.

As shown in FIG. 5, when a sufficient amount of time such as five seconds has passed between the time the reducing fuel is added and the fuel cut is executed, the detection signal of the sensor reaches the atmospheric oxygen concentration level relatively quickly and is then stable.

In contrast, when reducing fuel is added either right before or right after the fuel cut starts, it takes gradually takes longer for the detection signal from the sensor to drop down to the atmospheric oxygen concentration level. That is, there is more reducing fuel in the exhaust gas the closer the timing at which the reducing fuel is added is to the timing at which the fuel cut is performed, so it is conceivable that the affect from this reducing gas makes it take longer for the atmosphere around the sensor to become an air atmosphere.

On the other hand, while a fuel cut is being executed, air flows through the exhaust passage 18 so the amount of reducing fuel in the exhaust gas gradually decreases over time. At this time, the reducing fuel will gradually be consumed by being combusted in the exhaust passage 18. However, this combustion reaction progresses according to the amount of oxygen in the air flowing through the exhaust passage 18. Therefore, it is conceivable that the amount of reducing fuel present in the exhaust passage 18 decreases according to the amount of oxygen that has flowed through the exhaust passage 18.

Thus, in this example embodiment, the amount of reducing fuel added into the exhaust gas and the amount of oxygen in the air flowing through the intake passage 18 is integrated at fixed intervals of time from the point at which reducing fuel starts to be added. Then the amount of reducing fuel remaining in the exhaust passage 18 (hereinafter this amount will be referred to as the "remaining amount") is estimated by obtaining the difference between the amount of reducing fuel and the amount of oxygen (or more precisely, by obtaining a value that is the result of correcting the difference between the amount of reducing fuel and the amount of oxygen by balancing the reducing fuel decrease rate and the flowrate of the oxygen). The ECU 52 executes atmospheric learning when this estimated value of the remaining amount has fallen to a level that will not affect the oxygen concentration in the exhaust passage 18.

Figure 2:
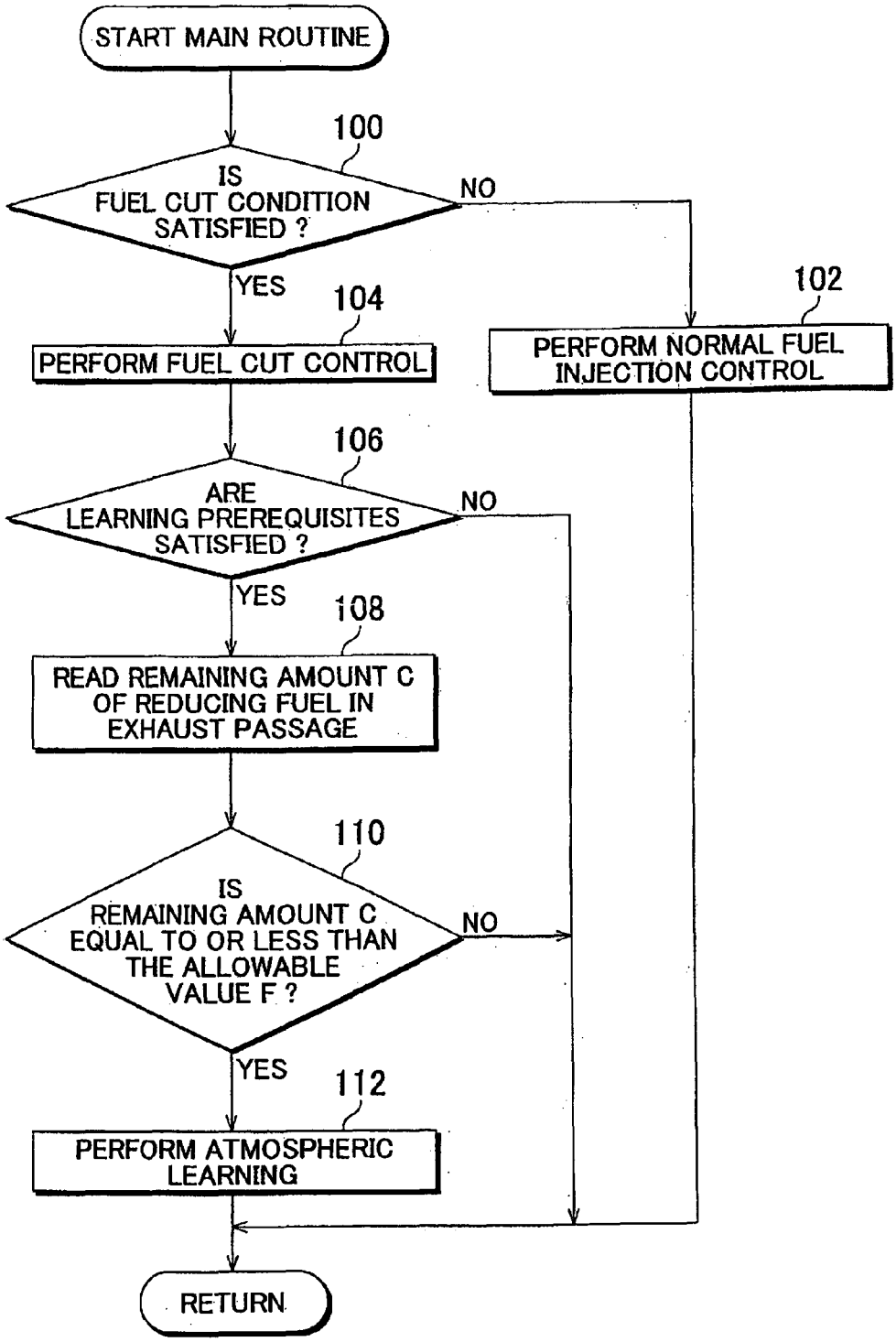
FIG. 2 is a flowchart illustrating a main routine executed in the first example embodiment of the invention.
Figure 3:
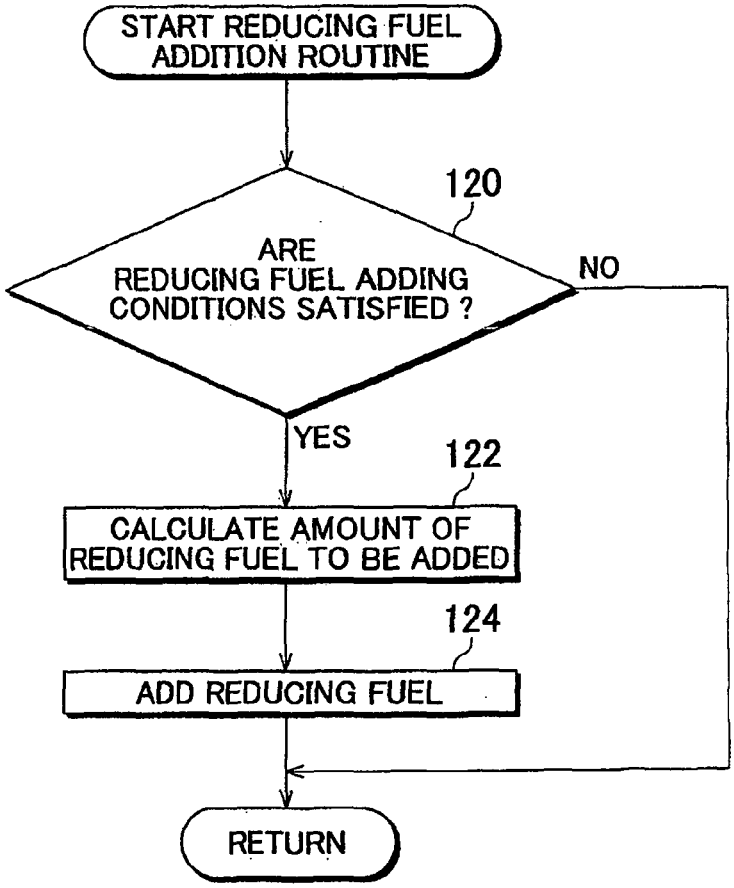
FIG. 3 is a flowchart illustrating a reducing fuel addition routine executed in the first example embodiment of the invention.
Figure 4:
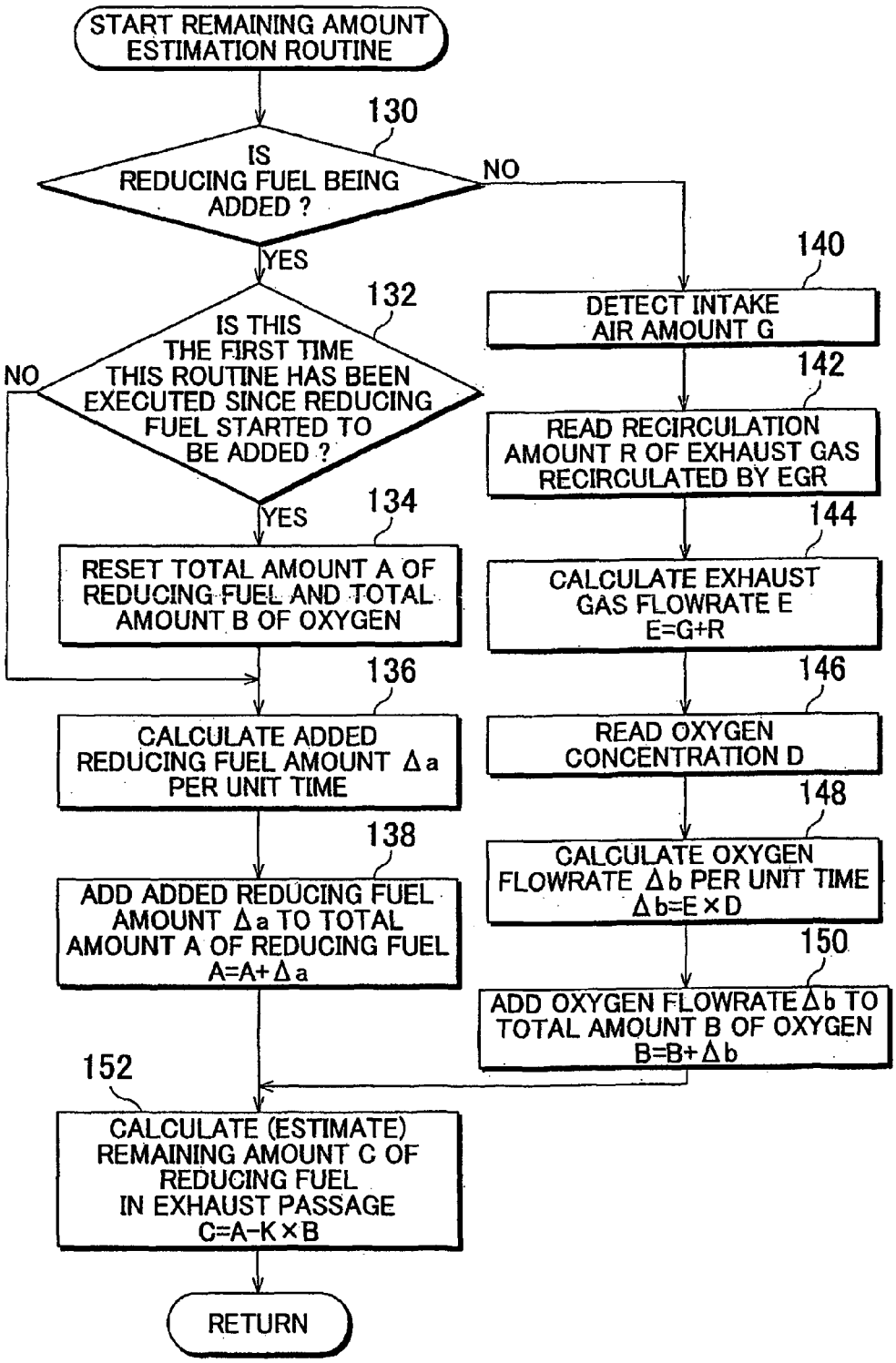
FIG. 4 is a flowchart of a remaining amount estimation routine executed in the first example embodiment of the invention.

FIGS. 2 to 4 are flowcharts illustrating routines executed by the ECU 52 in order to realize the system operation according to the example embodiment. Incidentally, the three routines shown in FIGS. 2 to 4 are started when the internal combustion engine 10 is started up, and are executed independently from one another at fixed intervals of time.

First, the main routine shown in FIG. 2 will be described. First in step 100 of this routine, the ECU 52 determines whether a fuel cut condition is satisfied. One example of a fuel cut condition is that the internal combustion engine 10 be decelerating from a high speed according to the detection signals from the engine speed sensor 48 and the accelerator operation amount sensor 50, for example.

If the determination in step 100 is NO, then normal fuel injection control is executed in step 102, after which the process returns to the beginning. Incidentally, when normal fuel injection control is executed, EGR control is also executed as necessary. Also, if the determination in step 100 is YES, then fuel cut control is executed in step 104 such that fuel injection from the fuel injection valves 24 is temporarily halted.

Next, in step 106, the ECU 52 determines whether learning prerequisites for performing atmospheric learning are satisfied. Specific examples of these prerequisites include 1) that the internal combustion engine 10 have started to decelerate from an operating state in which the engine speed is equal to or greater than a predetermined value, 2) that a predetermined period of time have passed after the internal combustion engine 10 started to decelerate (i.e., after an accelerator operation ended), and 3) that a fixed period of time have passed after throttle control during the fuel cut ended (i.e., after opening and closing control of the throttle valve 16 for promoting scavenging of the exhaust passage 18 ended), and the like. If the determination in step 106 is NO, this cycle of the routine ends and the process returns to the beginning.

If, on the other hand, the determination in step 106 is YES, the ECU 52 reads the remaining amount C of reducing fuel in the exhaust passage 18 in step 108. This remaining amount C is the amount of reducing fuel that is estimated to currently be remaining from the entire amount of reducing fuel that had been added into the exhaust gas by the fuel adding valve 32, and is calculated according to a remaining amount estimation routine (see FIG. 4) that will be described later. Incidentally, the remaining amount C is reset to zero when reducing fuel adding control is performed a sufficient amount of time in advance, i.e., when a sufficient amount of time has passed after execution of the reducing fuel adding control, as well as when reducing fuel adding control is not performed at all.

Then in step 110, the ECU 52 determines whether the remaining amount C of reducing fuel is equal to or less than an allowable value F stored in the ECU 52 in advance. In this case, the allowable value F is set as a remaining amount of reducing fuel that will not affect atmospheric learning even if it remains in the exhaust gas. Therefore, if the determination in step 110 is YES, the process proceeds on to step 112 and atmospheric learning is performed. If, on the other hand, the determination in step 110 is NO, it is estimated that the conditions are not suitable for atmospheric learning so the process returns to the beginning without atmospheric learning being performed.

Next, the reducing fuel addition routine shown in FIG. 3 will be described. First in step 120 of this routine, the ECU 52 determines whether the necessary conditions for adding reducing fuel are satisfied. Specific examples of these conditions include 1) that a sufficient amount of time have passed since the last addition of reducing fuel such that it can be estimated that the amount of $NO_x$ stored in the exhaust gas control catalyst 22 has reached a certain level, and 2) that the operating state of the internal combustion engine 10 will not be affected even if reducing fuel was to be added, and the like.

If the determination in step 120 is YES, the ECU 52 calculates the amount of reducing fuel to be added (hereinafter simply referred to as the "added amount") in step 122. This added amount is variably set by the ECU 52 according to the operating state of the internal combustion engine 10 and the state of the exhaust gas control catalyst 22 and the like. Next in step 124, the fuel adding valve 32 is operated such that the calculated added amount of reducing fuel is added into the exhaust gas, after which the process returns to the beginning. If, on the other hand, the determination in step 120 is NO, the process returns to the beginning without the reducing fuel being added.

Next, the routine of the remaining amount estimation routine shown in FIG. 4 will be described. First in step 130 of this routine, the ECU 52 determines whether reducing fuel is being added according to the reducing fuel addition routine described above. If the determination in step 130 is YES, then the process proceeds on to step 132, which will be described later. If, on the other hand, the determination in step 130 is NO, then the process proceeds on to step 140.

In step 132, the ECU 52 determines whether this is the first time that this routine has been executed since reducing fuel started to be added. If the determination in step 132 is YES, then the ECU 52 resets the total amount A of reducing fuel and the total amount B of oxygen to zero in step 134. If, on the other hand, the determination in step 132 is NO, the process skips to step 136, which will be described later, without executing step 134.

Here, the total amount A of reducing fuel represents the added amount of reducing fuel added from when the reducing fuel starts being added until it stops being added. While reducing fuel is being added, the total amount A of reducing fuel gradually increases every time the remaining amount estimation routine is executed. Incidentally, the remaining amount estimation routine is executed repeatedly at fixed predetermined intervals of time. The total amount A thus becomes a fixed value when the reducing fuel stops being added.

Also, the total amount B of oxygen indicates the amount of oxygen within the total amount of exhaust gas flowing through the exhaust passage 18 from the time the reducing fuel has finished being added until the remaining amount is estimated in this cycle of the routine. In this case, the exhaust gas also contains air that flows during the fuel cut. Therefore, the total amount B of oxygen gradually increases each time the remaining amount estimation routine is performed after the reducing fuel has finished being added, and is reset to zero when reducing fuel starts to be added the next time.

Next, in step 136, the ECU 52 calculates the added amount of the reducing fuel per unit time as the added reducing fuel amount Δa. In this case, the added amount of the reducing fuel set by the ECU 52 when the reducing fuel addition routine is executed, for example, is used to calculate the added reducing fuel amount Δa. Then in step 138, the ECU 52 adds the added reducing fuel amount Δa calculated in this cycle of the remaining amount estimation routine to the total amount A of the reducing fuel calculated in the last cycle of the routine in order to calculate the total amount A of reducing fuel, as shown in Equation 1 below.

$$A=A+\Delta a \quad \text{(Equation 1)}$$

Meanwhile, if reducing fuel is not being added, the process proceeds from step 130 to step 140, where the ECU 52 detects the intake air amount G based on the detection signal from the airflow meter 42. Also, in step 142, the ECU 52 reads the recirculation amount R per unit time of exhaust gas recirculated to the intake passage 12 if the EGR control is being executed.

Next, in step 144, the ECU 52 calculates the flowrate of exhaust gas E (i.e., the exhaust gas flowrate) using the intake air amount G and the recirculation amount R of the exhaust gas, as shown in Equation 2 below.

$$E=G+R \quad \text{(Equation 2)}$$

Also, in step 146, the ECU 52 reads the oxygen concentration D detected by the A/F sensor 46. In step 148, the ECU 52 calculates the oxygen flowrate Δb per unit time using the exhaust gas flowrate E and the oxygen concentration D.

$$\Delta b=E\times D \quad \text{(Equation 3)}$$

Then in step 150, the ECU 52 adds the oxygen flowrate Δb calculated in this cycle of the remaining amount estimation routine to the total amount B of oxygen calculated in the last cycle of the routine in order to calculate the total amount B of oxygen, as shown in Equation 4 below.

$$B=B+\Delta b \quad \text{(Equation 4)}$$

Finally, in step 152, the remaining amount C of reducing fuel in the exhaust passage 18 is calculated (i.e., estimated) using the total amount A of reducing fuel, the total amount B of oxygen, and a predetermined coefficient K, as shown in Equation 5 below. In this equation, the coefficient K is a coefficient for balancing the reducing fuel decrease rate and the oxygen flowrate.

$$C=A-K\times B \quad \text{(Equation 5)}$$

In this way, in this example embodiment, the ECU 52 calculates the amount corresponding to the difference between the total amount A of reducing fuel and the total amount B of oxygen, and from this is able to estimate the remaining amount C of reducing fuel remaining in the exhaust passage 18. As a result, the ECU 52 is able to determine in step 110 of the main routine shown in FIG. 2 whether to perform atmospheric learning using this remaining amount C.

As described above, according to this example embodiment, the ECU 52 can estimate the remaining amount C of reducing fuel according to the total amount A of reducing fuel and the total amount B of oxygen in the exhaust gas after reducing fuel has been added. Then using this remaining amount C, the ECU 52 is able to easily determine whether normal atmospheric learning is possible.

Therefore, even if the operating state of the internal combustion engine 10 or the timing at which reducing fuel is added or the like changes, the ECU 52 need only wait without executing atmospheric learning for only the period of time during which the remaining amount C of reducing fuel estimated according to these conditions exceeds the allowable value F. Then when the remaining amount C drops down to the allowable value F, normal learning can be quickly started, thus keeping the waiting time (i.e., standby time) until learning starts to the very minimum. Accordingly, the opportunities for learning increase which increases the efficiency, while maintaining high learning accuracy.

Also, when calculating the total amount A of reducing fuel, the ECU 52 calculates the added reducing fuel amount Δa per unit time, and integrates this added reducing fuel amount Δa at fixed intervals of time. As a result, when reducing fuel is added, the latest total amount A of reducing fuel can be accurately obtained each time the added reducing fuel amount Δa is integrated.

Also, when calculating the total amount B of oxygen, the ECU 52 calculates the oxygen flowrate Δb per unit time, and integrates this oxygen flowrate Δb every fixed period of time. Accordingly, even if the intake air amount G and the oxygen concentration D are constantly changing after reducing fuel has been added, the latest total amount B of oxygen in the exhaust gas can still be accurately obtained each time the oxygen flowrate Δb is integrated.

Furthermore, the exhaust gas flowrate E used to calculate the total amount B of oxygen is obtained as the sum of the intake air amount G and the exhaust gas recirculation amount R. Therefore, when some of the exhaust gas is recirculated to the intake system via the EGR passage 36, the effect from this recirculation can be reflected in the calculation results of the total amount B of oxygen. As a result, the total amount B of oxygen can be correctly calculated even in the internal combustion engine 10 provided with the EGR passage 36.

Incidentally, in the first example embodiment described above, step 104 in FIG. 2 represents a specific example of fuel cutting means, and step 112 represents a specific example of learning means. Also, step 110 in FIG. 2 and step 152 in FIG. 4 represent specific examples of remaining amount determining means. Moreover, steps 140 to 150 in FIG. 4 represent specific examples of total oxygen amount detecting means, and steps 136 and 138 represent specific examples of total reducing fuel amount calculating means.

Next, a second example embodiment of the invention will be described with reference to FIGS. 6 to 9. Incidentally, the system in this example embodiment is also structured as shown in FIG. 1, just like the system in the first example embodiment described above. However, the second example embodiment differs from the foregoing first example embodiment in that it is realized by using the routines shown in FIGS. 7 to 9 instead of the routines shown in FIGS. 2 to 4.

Figure 6A:
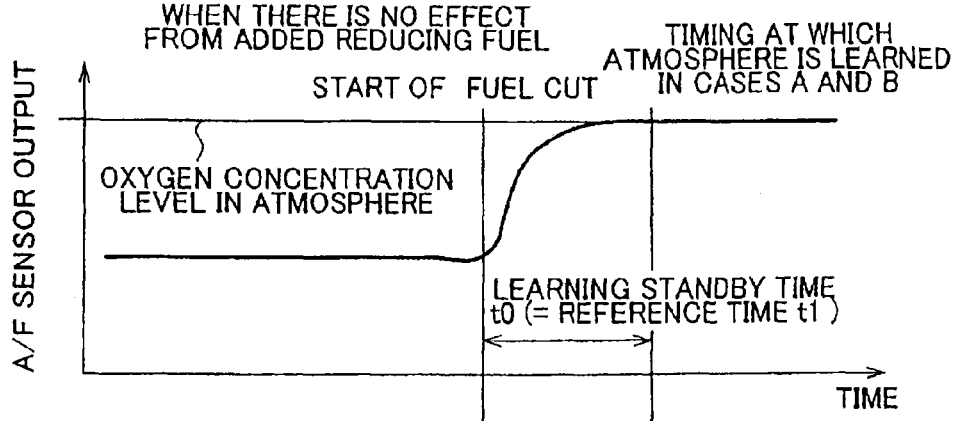
FIGS. 6A, 6B, and 6C are charts illustrating the details of control according to the second example embodiment of the invention.
Figure 6B:
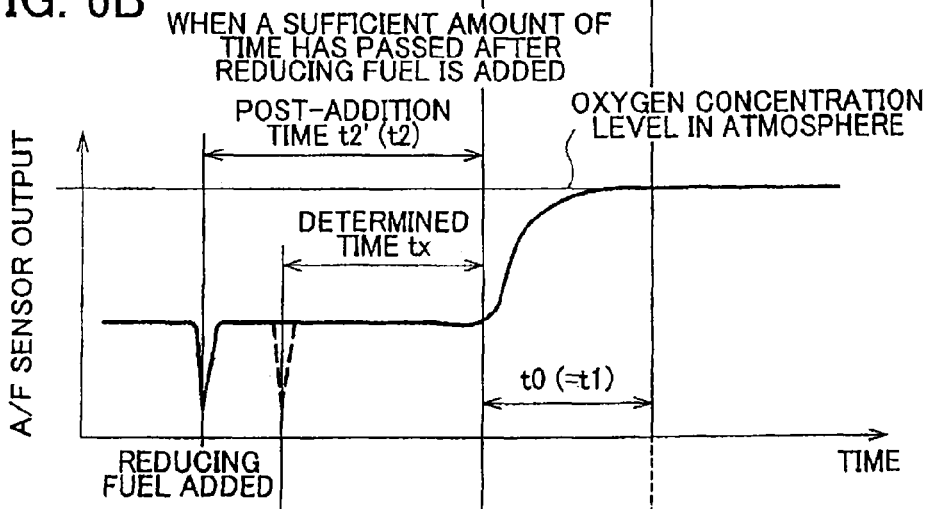
Figure 6C:
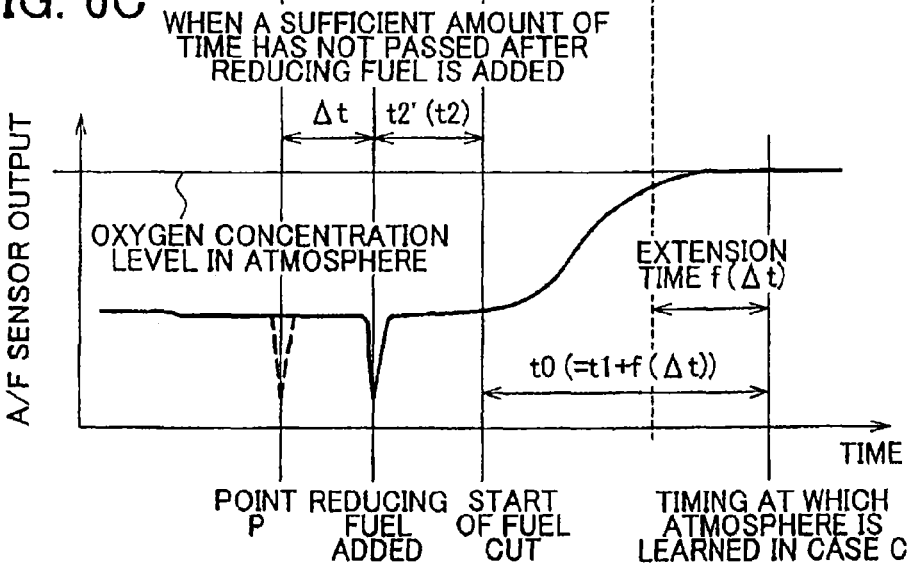

FIGS. 6A, 6B, and 6C are charts illustrating the details of control according to this second example embodiment. In this example embodiment, when the period of time between the time that a fuel cut starts to be performed and the time atmospheric learning is performed is designated as learning standby time t0, this learning standby time t0 is changed according to the timing at which reducing fuel is added.

That is, the ECU 52 measures the time that passes after reducing fuel has been added until a fuel cut starts to be performed as the time t2 elapsed after adding the reducing fuel (hereinafter simply referred to as "post-addition time t2"), and sets the learning standby time t0 according to this measurement result. A specific example of this when the reducing fuel is added at three different timings will now be described. Incidentally, in the following description, post-addition times t2' and t2" represent specific examples of the post-addition time t2, which is a variable.

First, FIG. 6A shows a case in which a fuel cut and atmospheric learning are executed while there is no affect from the added reducing fuel. In this case, the learning standby time t0 is set equal to a reference time t1 stored in the ECU 52 in advance. That is, the ECU 52 executes atmospheric learning after the predetermined reference time t1 has passed since the fuel cut started.

Here, the reference time t1 is set as the time that must pass before normal atmospheric learning can be performed after a fuel cut starts. That is, there is a certain degree of time lag between the time the fuel cut starts to be executed and the time that the atmosphere around the A/F sensor 46 becomes a stable air atmosphere. During this time lag, the detection signal from the sensor tends to be unstable due to the oxygen concentration level being different than the atmospheric oxygen concentration level. The reference time t1 is the waiting or standby time in order to avoid atmospheric learning being performed when the detection signal from the sensor is in this unstable state.

Next, FIG. 6B shows a case in which a fuel cut is performed after a relatively long period of time has passed (i.e., post-addition time t2') after reducing fuel is added. In this case, the ECU 52 calculates the determined time tx according to the intake air amount of the internal combustion engine 10, the engine speed, and the length of the reference time t1, for example, and compares this determined time tx to the post-addition time t2'.

Here, the determined time tx is defined as the shortest post-addition time with which the learning standby time t0 can still be set equal to the reference time t1 even if reducing fuel is added before the fuel cut. That is, in FIG. 6B, when a point that is the determined time tx before the actual start timing of the fuel cut is designated as reference point P and reducing fuel is added before this reference point P, the reducing fuel will stop affecting atmospheric learning within the reference time t1.

Therefore, when it is determined that the post-addition time t2' is equal to or greater than the determined time tx, the ECU 52 sets the learning standby time t0 equal to the reference time t1 (Equation 6 below), as shown in FIG. 6B.

$$t0=t1 \quad \text{(Equation 6)}$$

In this way, normal atmospheric learning can be performed once the reference time t1 has passed as long as it is after a reducing fuel addition that was performed relatively early. Incidentally, the map data and calculation procedures and the like for calculating the determined time tx are stored in the ECU 52 in advance.

Next, FIG. 6C shows a case in which a fuel cut is performed after a relatively short period of time (i.e., the post-addition time t2") has passed after reducing fuel is added. In this case, the post-addition time t2" is shorter than the determined time tx so the ECU 52 calculates the time difference Δt between the two (i.e., Δt=tx−t2"), and then calculates an extension time f (Δt) according to this time difference Δt.

Here, in the case shown in FIG. 6C, reducing fuel is added right before the fuel cut so there is still some effect from the reducing fuel even after the reference time t1 has passed. Therefore, the extension time f (Δt) is defined as the time that it takes after the reference time t1 has passed until there is no longer any effect from the reducing fuel.

Also, the extension time f (Δt) is set as a function of the time difference Δt (or the post-addition time t2), for example. The data of this function is stored in advance in the ECU 52. Incidentally, although not illustrated in this example embodiment, the extension time f (Δt) may be a multivariable function that changes according to the time difference Δt and other parameters (such as the amount of added reducing fuel, the oxygen concentration, or the exhaust gas flowrate or the like).

Then, in the case shown in FIG. 6C, the ECU 52 sets the sum of the reference time t1 and the extension time f (Δt) as the learning standby time t0 (Equation 7 below). As a result, normal atmospheric learning can be performed once the learning standby time to has passed after a fuel cut, even if reducing fuel has been added relatively recently.

$$t0=t1+f(\Delta t) \quad \text{(Equation 7)}$$

Figure 7:
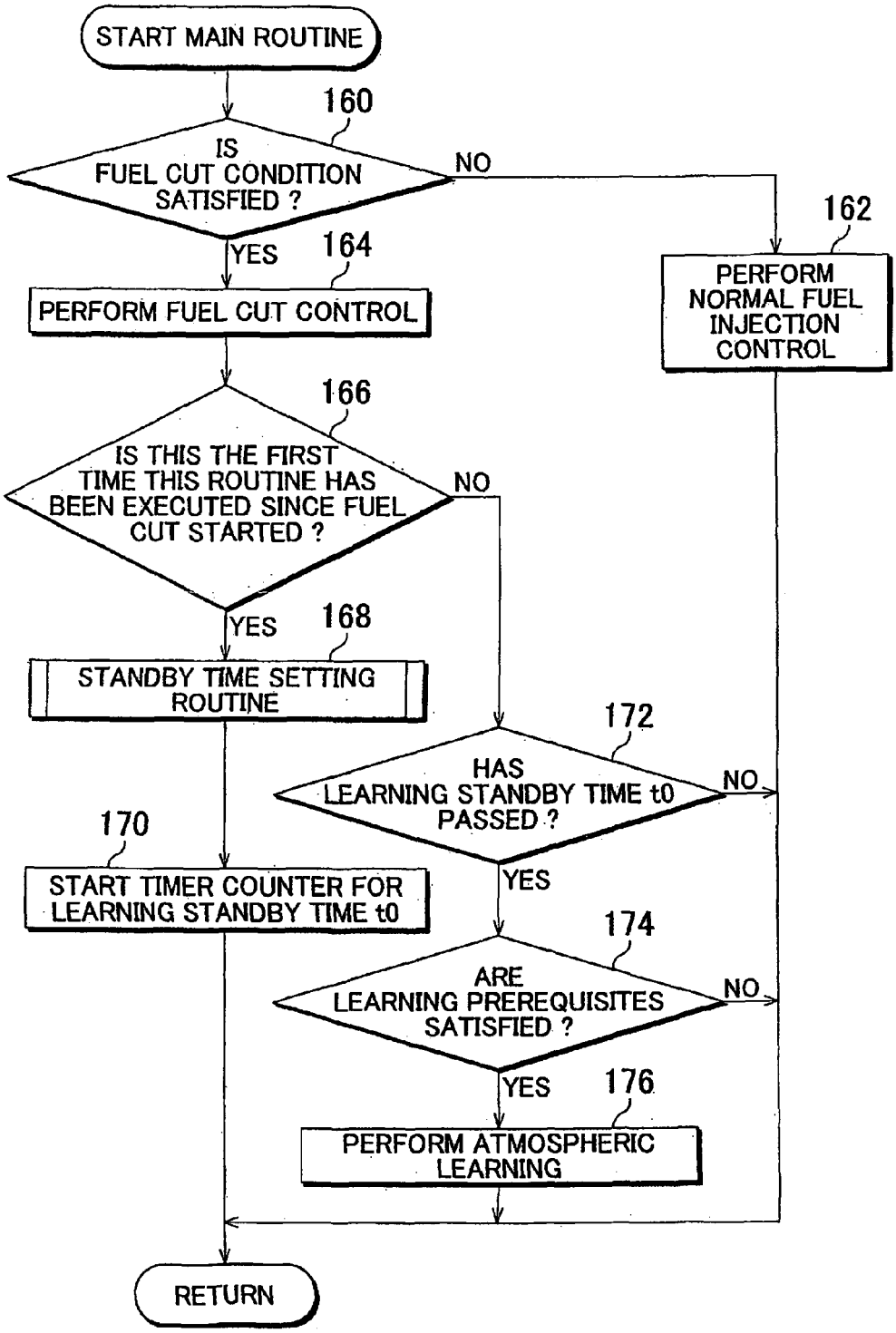
FIG. 7 is a flowchart of a main routine executed in the second example embodiment of the invention.
Figure 8:
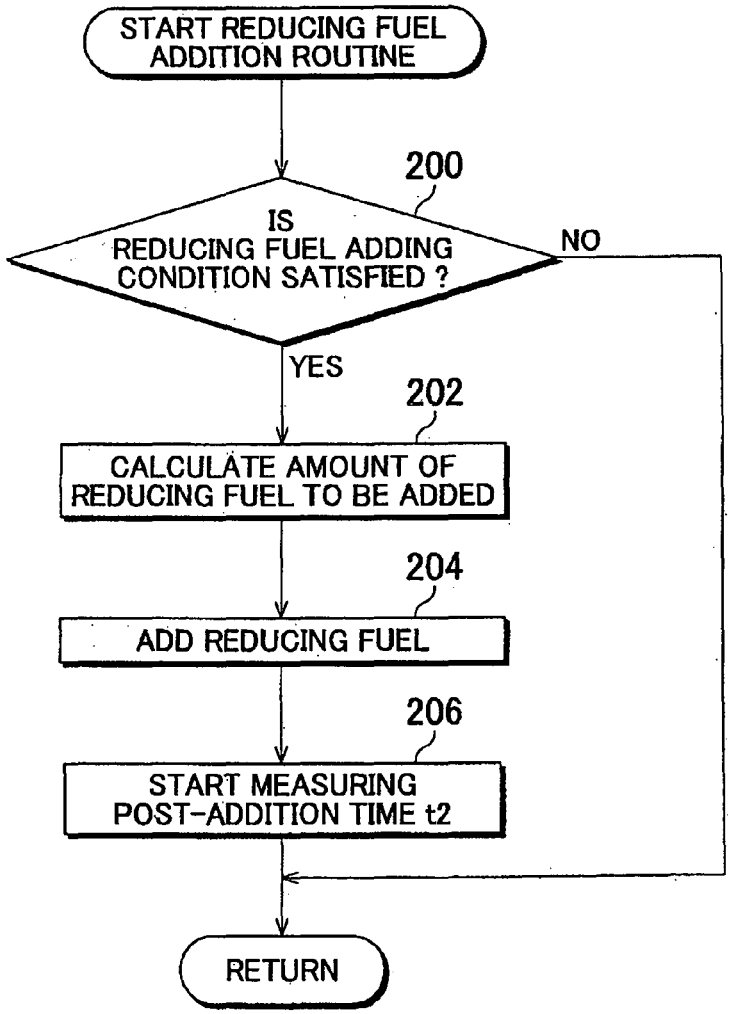
FIG. 8 is a flowchart of a reducing fuel addition routine executed in the second example embodiment of the invention.
Figure 9:
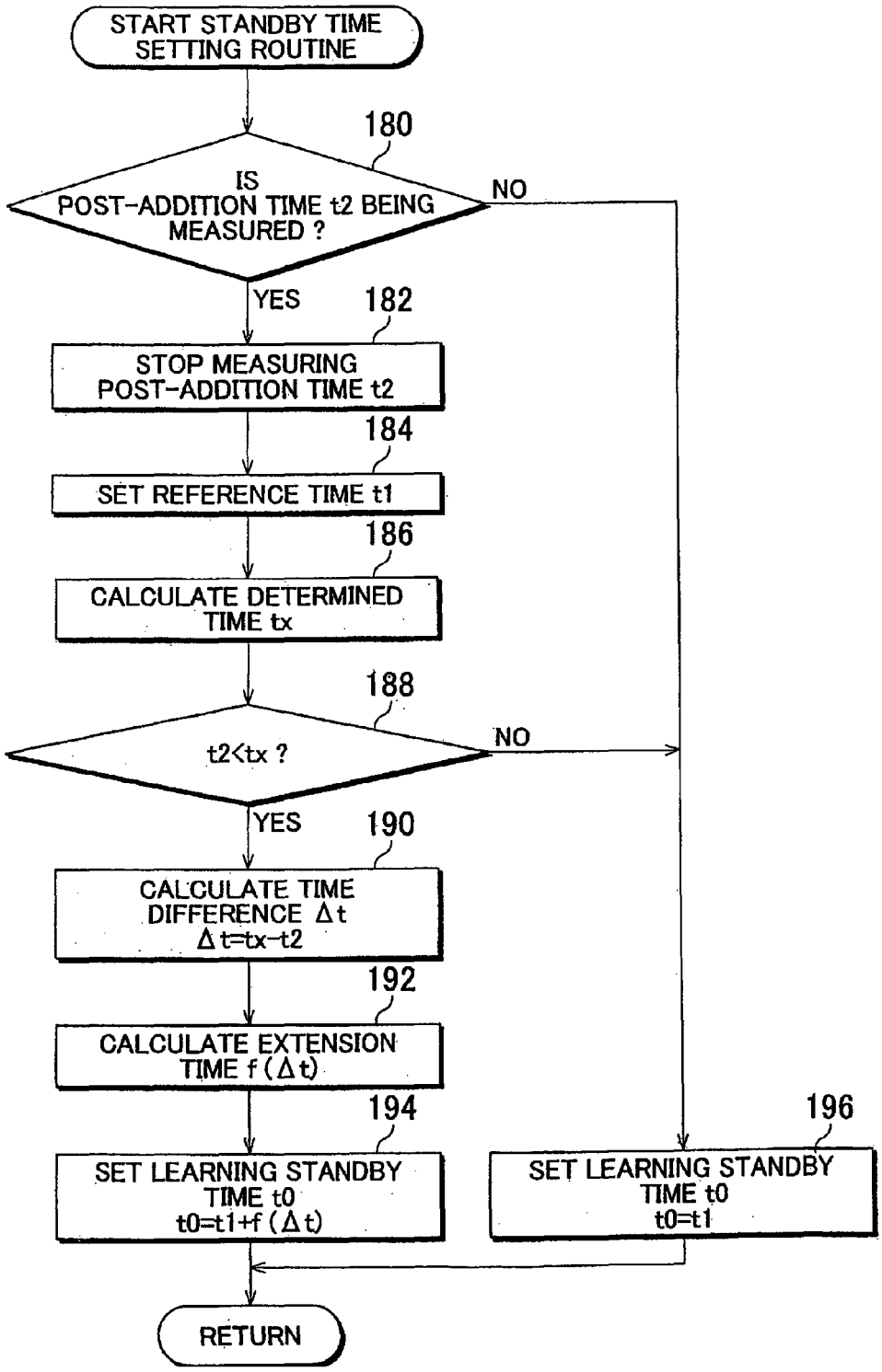
FIG. 9 is a flowchart of a standby time setting routine executed in the second example embodiment of the invention.

FIGS. 7 to 9 are flowcharts of routines executed by the ECU 52 to realize the system operation of this example embodiment. Incidentally, the two routines shown in FIGS. 7 and 8 are started when the internal combustion engine 10 is started up, and are executed independently from one another at fixed intervals of time. Also, the routine in FIG. 9 is executed partway through the routine in FIG. 7.

First, the main routine shown in FIG. 7 will be described. First in this routine, steps 160, 162, and 164, which are the same as steps 100, 102, and 104 in the first example embodiment (see FIG. 2), are performed. Here, when a fuel cut has been executed, the ECU 52 determines in step 166 whether this is the first time that this routine has been executed since reducing fuel started to be added.

If the determination in step 166 is YES, then the ECU 52 executes the standby time setting routine (see FIG. 9), which will be described later, in step 168 and sets the learning standby time t0 for the current operating state of the internal combustion engine 10. Then in step 170, the ECU 52 starts a timer counter for measuring the learning standby time t0.

If, on the other hand, the determination in step 166 is NO, the ECU 52 determines in step 172 whether the learning standby time to has passed based on the timer counter. If the determination in step 172 is YES, then the ECU 52 determines in step 174 whether learning prerequisites are satisfied. These learning prerequisites are the same as those in step 106 in the first example embodiment.

If the determination in step 174 is YES, then the learning standby time t0 has passed and the learning prerequisites are satisfied so the ECU 52 performs atmospheric learning in step 176. If, on the other hand, the determination in either step 172 or step 174 is NO, then the process returns to the beginning without atmospheric learning being performed.

Next, the reducing fuel addition routine illustrated in FIG. 8 will be described. First in this routine, steps 200, 202, and 204, which are the same as steps 120, 122, and 124 in the first example embodiment (see FIG. 3), are performed. Here, when reducing fuel is added, the ECU 52 starts the timer counter to measure the post-addition time t2 in step 206 and then the process returns to the beginning.

Next, the standby time setting routine illustrated in FIG. 9 will be described. In this routine, the ECU 52 first determines in step 180 whether the post-addition time t2 is currently being measured. This standby time setting routine is performed only once when the main routine is first executed after a fuel cut starts.

Therefore, when the determination in step 180 is YES, it means that the post-addition time t2 is currently being measured and can therefore be determined. Accordingly, the post-addition time t2 stops being measured by the ECU 52 reading the value of the timer counter in step 182.

Next, in step 184, the ECU 52 sets the reference time t1 by reading the data stored in advance in the ECU 52. In this case, the reference time t1 may be variably set according to, for example, the engine speed, the intake air amount of the internal combustion engine 10, or the like. Then in step 186, the ECU 52 calculates the determined time tx according to, for example, the length of the reference time t1, the engine speed, and the intake air amount of the internal combustion engine 10, and the like.

Then in step 188, the ECU 52 determines whether the post-addition time t2 is shorter than the determined time tx. If the determination here is YES, it means that a fuel cut has been executed right after the reducing fuel addition, as shown in FIG. 6C described above. Therefore in step 190, the ECU 52 calculates the time difference Δt between the post-addition time t2 and the determined time tx. Then in step 192, the ECU 52 calculates the extension time f (Δt) using this time difference Δt, and in step 194, the ECU 52 sets the learning standby time t0 by adding this extension time f (Δt) to the reference time t1, after which the process returns to the beginning.

If, on the other hand, the determination in step 180 is NO, it means that the post-addition time t2 is not being measured. This state occurs when reducing fuel is not added before a fuel cut, as shown in FIG. 6A. Therefore, in step 196, the ECU 52 sets the learning standby time t0 equal to the reference time t1, after which the process returns to the beginning.

Also, if the determination in step 188 is NO, it means that the post-addition time t2 is equal to or longer than the determined time tx. This state occurs when reducing fuel is added a sufficient amount of time before a fuel cut, as shown in FIG. 6B. Therefore, in this case as well, the ECU 52 sets the learning standby time t0 equal to the reference time t1, after which the process returns to the beginning.

In this way, according to this example embodiment the ECU 52 is able to appropriately set the learning standby time to until learning can be performed normally after a fuel cut starts, according to the measured post-addition time t2. That is, the ECU 52 waits to perform atmospheric learning until there is no longer any affect from the reducing fuel by setting the learning standby time to longer when reducing fuel is added right before a fuel cut starts, for example.

Also, the ECU 52 can quickly execute atmospheric learning after a fuel cut starts by setting the learning standby time t0 shorter when a sufficient amount of time has passed after reducing fuel has been added. As a result, the learning standby time t0 can be kept to the very minimum even if the operating state of the internal combustion engine 10 or the timing at which reducing fuel is added or the like changes. Thus, the opportunities for learning can be increased such that the learning efficiency can be improved, while improving the accuracy of atmospheric learning.

In this case, the ECU 52 can set the learning standby time t0 necessary even if reducing fuel is not added, as the reference time t1. Also, the ECU 52 can calculate the shortest post-addition time t2 without extending the reference time t1 even if reducing fuel has been added right before a fuel cut, as the determined time tx.

As a result, when the actual post-addition time t2 is shorter than the determined time tx, the ECU 52 can determined that the reducing fuel in the exhaust gas will affect the atmospheric learning because the time between the reducing fuel addition and the fuel cut is too short. In this case, the ECU 52 can appropriately correct the learning standby time t0 so that it is extended by the extension time f (Δt). Accordingly, the ECU 52 can set the learning standby time t0 so that it is just long enough according to the timing at which reducing fuel is added and the like.

Incidentally, in the foregoing second example embodiment, step 164 in FIG. 7 is a specific example of fuel cutting means. Also, step 168 is a specific example of standby time setting means, and step 176 is a specific example of learning means. Also, step 206 in FIG. 8 and step 182 in FIG. 9 are both specific examples of time measuring means. Moreover, step 184 in FIG. 9 is a specific example of reference time setting means, and step 186 is a specific example of determined time estimating means.

Also, in the first and second example embodiments, the internal combustion engine 10 is described as a diesel engine but the invention is not limited to this. That is, the invention may also be applied to a gasoline engine or an internal combustion engine that uses another type of fuel.

Further, in the first and second example embodiments, the detection signal from the A/F sensor 46 is stored as the learned value of atmospheric learning but the invention is not limited to this. For example, the difference or ratio between the detection signal value from the sensor and reference signal value may also be stored as the learned value.

Furthermore, in the first and second example embodiments, the reduction process of the exhaust gas control catalyst 22 is performed by adding fuel (i.e., reducing fuel) into the exhaust gas by the fuel adding valve 32. However, the reducing fuel adding means of the invention is not limited to that described in the first and second example embodiments. For example, the reduction process of the exhaust gas control catalyst 22 may be performed by injecting reducing fuel using the normal fuel injection valves 24 at a timing other than the regular fuel injection timing. That is, the invention may also be applied to fuel injection control referred to as so-called post injection control, and rich spike control, and the like.

While the invention has been described with reference to what are considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single element, are also within the scope of the invention.

The invention claimed is:

1. An internal combustion engine control method comprising:

executing fuel cut control;

calculating the total amount of reducing fuel added into exhaust gas between the time the reducing fuel starts to be added and the time the reducing fuel stops being added;

calculating the total amount of oxygen in the exhaust gas flowing through an exhaust passage after the reducing fuel stops being added;

calculating the remaining amount of reducing fuel in the exhaust gas based on the calculated total amount of reducing fuel and the calculated total amount of oxygen;

comparing the calculated remaining amount of reducing fuel with an allowable value; and performing atmospheric learning when the remaining amount of reducing fuel is less than the allowable value.

2. The internal combustion engine control method according to claim 1, wherein the total amount of the reducing fuel is calculated by calculating an added amount of reducing fuel per unit time according to the amount of reducing fuel added into the exhaust gas, and integrating the calculated added amount each time the unit time passes.

3. The internal combustion engine control method according to claim 1, wherein the total amount of the oxygen is calculated by calculating the flowrate of oxygen per unit time using the amount of intake air drawn into the internal combustion engine and the concentration of oxygen in the exhaust gas, and integrating the calculated flowrate of oxygen each time the unit time passes.

4. An internal combustion engine control apparatus comprising:

a reducing fuel adding valve that adds reducing fuel into exhaust gas of the internal combustion engine;

an oxygen sensor that detects an oxygen concentration in the exhaust gas and outputs a detection signal indicative of the detected oxygen concentration; and a controller that controls an operating state of the internal combustion engine, wherein the controller includes control logic configured to halt the fuel injection according to the operating state of the internal combustion engine when a fuel injection is performed into intake air of the internal combustion engine, measure the time that has passed after the reducing fuel adding valve adds the reducing fuel until the fuel injection is halted, as a post-addition time, variably set a learning standby time according to the post-addition time measured, and perform atmospheric learning using the detection result from the oxygen sensor when the learning standby time has passed after the fuel injection is halted.

5. The internal combustion engine control apparatus according to claim 4, wherein the controller further includes control logic configured to correct the detection result of the oxygen sensor based on the difference between i) the detection result of the oxygen sensor when the learning standby time has passed after the fuel injection is halted, and ii) a predetermined oxygen concentration.

6. An internal combustion engine control apparatus comprising:

a reducing fuel adding valve that adds reducing fuel into exhaust gas of the internal combustion engine;

an oxygen sensor that detects an oxygen concentration in the exhaust gas and outputs a detection signal indicative of the detected oxygen concentration; and a controller that controls an operating state of the internal combustion engine, wherein the controller includes control logic configured to halt the fuel injection according to the operating state of the internal combustion engine when a fuel injection is performed into intake air of the internal combustion engine, calculate the total amount of reducing fuel added into the exhaust gas between the time that the reducing fuel adding valve starts to add the reducing fuel and the time that the reducing fuel adding valve stops adding the reducing fuel, calculate, using the detection result from the oxygen sensor, the total amount of oxygen in the total amount of exhaust gas discharged from the internal combustion engine after the reducing fuel adding valve has stopped adding the reducing fuel, determine whether the reducing fuel in the exhaust gas has decreased to an allowable value based on the total amount of reducing fuel calculated and the total amount of oxygen calculated, and perform atmospheric learning using the detection result from the oxygen sensor when the fuel injection is halted and it has been determined that the reducing fuel in the exhaust gas has decreased to the allowable value.

7. The internal combustion engine control apparatus according to claim 6, wherein the controller further includes control logic to estimate the remaining amount of reducing fuel in the exhaust gas from the difference between the total amount of reducing fuel calculated and the total amount of oxygen in the total amount of exhaust gas calculated.

8. The internal combustion engine control apparatus according to claim 6, wherein the controller further includes control logic to calculate the total amount of the reducing fuel by calculating an added amount of the reducing fuel per unit time according to the amount of reducing fuel added into the exhaust gas by the reducing fuel adding valve, and integrating the calculated value of the added amount each time the unit time passes.

9. The internal combustion engine control apparatus according to claim 6, wherein the allowable value is set as a remaining amount of reducing fuel that will not affect atmospheric learning even if reducing fuel of that amount remains in the exhaust gas.

10. The internal combustion engine control apparatus according to claim 6, wherein the controller further includes control logic to correct the detection result of the oxygen concentration sensor based on the difference between i) the detection result of the oxygen sensor when the fuel injection is halted and it has been determined that the reducing fuel in the exhaust gas has decreased to the allowable value, and ii) a predetermined oxygen concentration.

11. The internal combustion engine control apparatus according to claim 6, wherein the internal combustion engine is a diesel engine.

12. The internal combustion engine control apparatus according to claim 6, further comprising:

an exhaust passage provided on an exhaust side of the internal combustion engine; and an exhaust gas control catalyst provided in the exhaust passage, which purifies $NO_x$ in the exhaust gas and traps particulate matter that is in the exhaust gas, wherein the oxygen sensor is arranged upstream of the exhaust gas control catalyst, with respect to the direction in which the exhaust gas flows.

13. The internal combustion engine control apparatus according to claim 6, wherein the controller feedback-controls a fuel injection quantity such that an actual air-fuel ratio approaches a target air-fuel ratio set according to the oxygen concentration detected by the oxygen sensor.

14. The internal combustion engine control apparatus according to claim 6, further comprising:

an intake air meter that detects a flowrate of air drawn into the internal combustion engine as an intake air amount, wherein the controller further includes control logic to calculate the total amount of the oxygen by calculating the flowrate of oxygen per unit time using the intake air amount detected by the intake air meter and the oxygen concentration detected by the oxygen sensor, and integrating the calculated value of the flowrate each time the unit time passes.

15. The internal combustion engine control apparatus according to claim 14, further comprising:

an exhaust gas recirculating valve that recirculates some of the exhaust gas into an intake system of the internal combustion engine, wherein the controller further includes control logic to calculate the flowrate of the oxygen using the flowrate of the exhaust gas recirculated into the intake system by the exhaust gas recirculating valve, the intake air amount, and the oxygen concentration.

16. An internal combustion engine control apparatus comprising:

a reducing fuel adding valve that adds reducing fuel into exhaust gas of the internal combustion engine;

an oxygen sensor that detects an oxygen concentration in the exhaust gas and outputs a detection signal indicative of the detected oxygen concentration; and a controller that controls an operating state of the internal combustion engine, wherein the controller includes control logic configured to halt the fuel injection according to the operating state of the internal combustion engine when a fuel injection is performed into intake air of the internal combustion engine, measure the time that has passed after the reducing fuel adding valve adds the reducing fuel until the fuel injection is halted, as a post-addition time, variably set a learning standby time according to the post-addition time measured, perform atmospheric learning using the detection result from the oxygen sensor when the learning standby time has passed after the fuel injection is halted, set, as a reference time, the time that it takes for the atmospheric learning to be performed normally after the fuel injection is halted, even if there is no effect from the reducing fuel added by the reducing fuel adding valve, calculate, as a determined time, the shortest post-addition time with which the learning standby time can still be set equal to the reference time even if the reducing fuel adding valve adds reducing fuel before the fuel injection is halted, correct the learning standby time according to a time difference between the actual post-addition time measured and the determined time when the actual post-addition time measured is shorter than the determined time, and set the learning standby time equal to the reference time when the actual post-addition time is equal to or longer than the determined time.

* * * * *